United States Patent [19]

Eckenrode et al.

[11] Patent Number: 4,512,544

[45] Date of Patent: Apr. 23, 1985

[54] BOTTOM POUR INGOT MOULD SYSTEM

[75] Inventors: Paul D. Eckenrode, Newton Falls; Richard P. Eisenbrei; James E. Nixon, both of Youngstown, all of Ohio

[73] Assignee: Microdot Inc., Darien, Conn.

[21] Appl. No.: 413,609

[22] Filed: Sep. 1, 1982

[51] Int. Cl.[3] ..... B22D 7/06; B22D 41/08

[52] U.S. Cl. ..... 249/109; 164/DIG. 6; 249/110; 249/139

[58] Field of Search ..... 164/322, 342, DIG. 6; 249/109, 110, 119, 120, 139, 174, 204, 205

[56] References Cited

U.S. PATENT DOCUMENTS 107,766 9/1870 Durfee ..... 249/109
1,647,660 11/1927 Perry ..... 249/168
3,237,909 3/1966 Bintzer et al. ..... 249/109
3,501,125 3/1970 Fransson ..... 249/110 X

FOREIGN PATENT DOCUMENTS 825293 12/1959 United Kingdom ..... 249/109

*Primary Examiner*—Nicholas P. Godici
*Assistant Examiner*—J. Reed Batten, Jr.
*Attorney, Agent, or Firm*—Lyman R. Lyon

[57] ABSTRACT

A bottom pour ingot mould system and more particularly a sprue plate having a plurality of horizontally extending runners therein and a plurality of upstanding guide pads spaced from the horizontal runners to effect positioning of each mould relative to an outlet in a horizontal runner. Molten steel is poured down a vertical runner, after which it moves horizontally then upwardly into the ingot mould.

3 Claims, 2 Drawing Figures

BOTTOM POUR INGOT MOULD SYSTEM

BACKGROUND OF THE INVENTION

1. Field of the Invention

The invention relates to a method of making steel ingots wherein the ingot mould is positioned relative to a sprue plate in a novel manner.

2. Description of the Prior Art

Steel ingots for steel rolling mills and steel forges are generally made by casting liquid steel into cast-iron ingot moulds. The liquid steel is either poured into the ingot mould or, in bottom pour systems, is introduced at the lower end and rises up the mould.

Bottom pour systems heretofore used experience difficulty in locating the ingot moulds relative to the necessary lateral and upstanding sprues often resulting in ruptured refractory parts and off center teeming of ingots.

SUMMARY OF THE INVENTION

The invention relates to a novel sprue plate for a bottom pour ingot mould system. The sprue plate has upstanding guide pads that engage and position an alignment flange on the ingot mould. The sprue plate and/or moulds can be of any desired configuration, e.g., round or rectangular.

DETAILED DESCRIPTION OF THE PREFERRED EMBODIMENT OF THE INVENTION

Figures 1, 2:
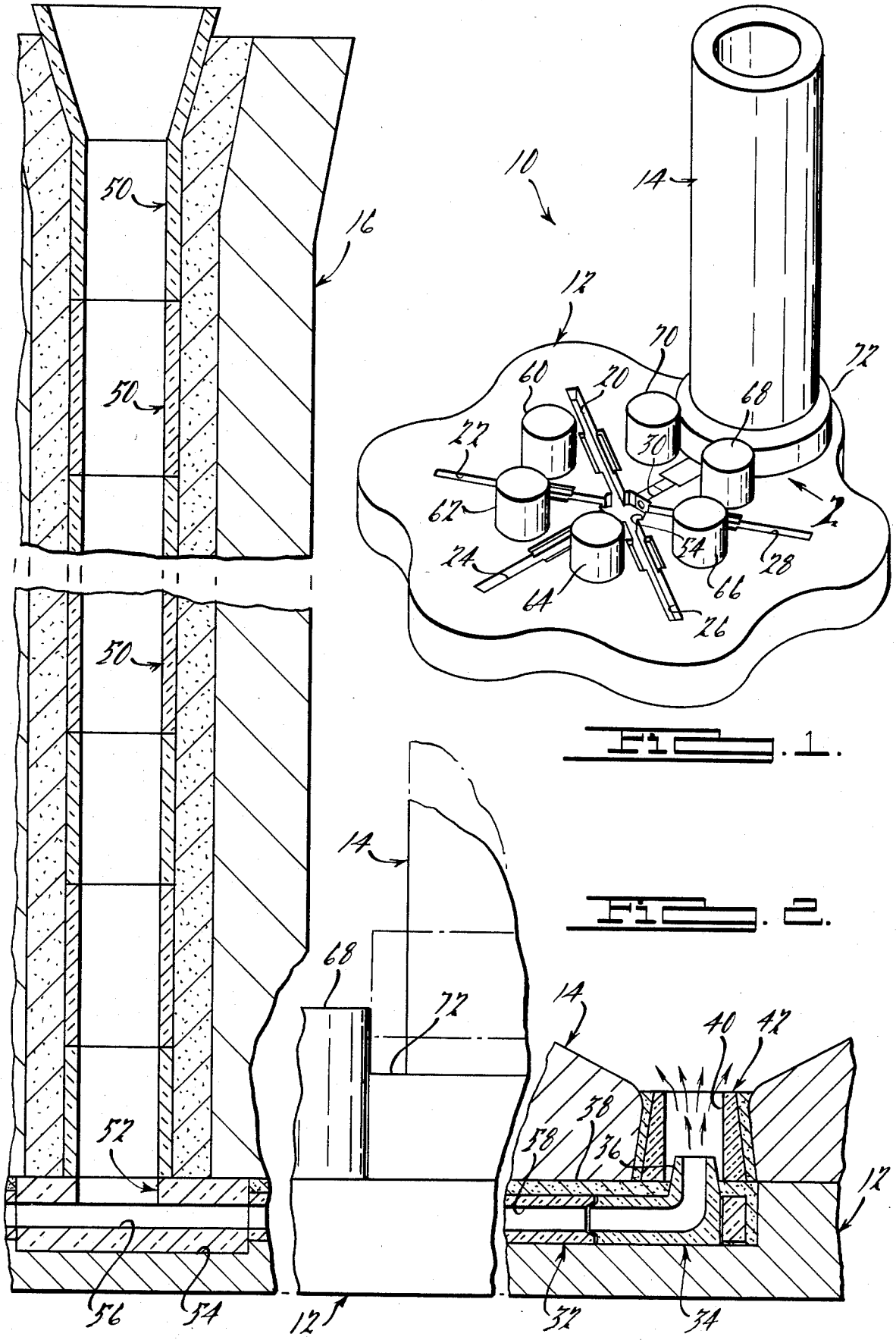
FIG. 1 is a perspective view of a sprue plate in accordance with the instant invention having a single ingot mould mounted thereon.
FIG. 2 is a fragmentary view, partially in section, taken in the direction of the arrow 2 of FIG. 1.

A bottom pour ingot mould system 10, in accordance with an exemplary constructed embodiment of the instant invention, comprises a sprue plate 12 for the acceptance of a plurality of ingot moulds 14. The sprue plate 12 illustrated in FIG. 1 of the drawing has a single ingot mould 14 mounted thereon, it being understood that the particular sprue plate 12 disclosed in FIG. 1 is adapted to mount six ingot moulds, each of which is fed from a common center runner 16, as will be described.

The sprue plate 12 is provided with a plurality of radially extending horizontal runners 20, 22, 24, 26, 28 and 30, each of which is adapted to feed an ingot mould 14. The sprue runners 20–30 are lined with hollow runner bricks 32, which terminate in an upstanding nozzle brick 34, one of which is shown in FIG. 2 of the drawing. It is to be noted that a nozzle portion 36 of the nozzle brick 34 extends above an upper surface 38 of the sprue plate 12 so as to telescope into a central passage 40 in an inlet liner 42 of the mould 14.

The sprue plate 12 is provided with the center runner 16 which has a plurality of stacked runner bricks 50 therein to provide for the acceptance of molten steel. The runner bricks 50 communicate with a spider brick 52 at the lower end thereof which is mounted in a central cavity 54 in the sprue plate 12. The spider brick has horizontal passageways 56 therein which communicate with central passages 58 in the runner bricks 32 and nozzle brick 34.

In accordance with the present invention, the sprue plate 12 is provided with a plurality of upstanding guide pads 60, 62, 64, 66, 68 and 70 that, in the constructed embodiment of the invention, are integral with the plate portion of the sprue plate 12. As seen in FIG. 2, the guide pads 68 and 70 cooperate with a radial flange 72 on the mould 14 to positively position the mould 14 in alignment with the nozzle 36 on the nozzle brick 34. Noting the relatively small clearance between the nozzle 36 on the nozzle brick 34 and the central aperture 40 in the inlet liner 42 of the mould 14, precise positioning of the mould 14 relative to the sprue plate 12 is imperative.

Moreover, since the nozzle 36 extends upwardly above the mould mounting surface 38 of the sprue plate 12, provision must be made for downward movement of the mould 14 relative to the sprue plate 12 while the mould 14 and sprue plate 12 are precisely aligned relative to one another. This is accomplished by extending the guide pads 60–70 upwardly a distance substantially greater than the height of the nozzle 36 above the surface 38. Thus, the mould 14 can be swung into engagement with the guide pads 68 and 70, as seen in FIG. 1 of the drawings and, while bearing thereagainst, be lowered over the nozzle 36 into engagement with the sprue plate 12. Positive alignment of the mould 14 with the nozzle 36 is insured by engagement of the mould 14 with the guide pads 68 and 70.

From the foregoing description it should be apparent that the rugged construction of the guide pads 60–70 and the orientation thereof relative to the nozzles in the sprue plate 12 provide a practical means for aligning the mould 14 with the nozzles 36 of the sprue plate 12.

While the preferred embodiment of the invention has been disclosed, it should be appreciated that the invention is susceptible of modification without departing from the scope of the following claims.

We claim:

1. A bottom pour ingot mould system comprising:

a sprue plate having a support surface for the support of an ingot mould, an inlet aperture for the acceptance of molten steel, an outlet aperture for the discharge of molten steel, and a horizontally extending runner below the support surface thereof communicating with the inlet and outlet apertures, a pair of vertically extending integral guide pads on said sprue plate between the inlet and outlet apertures therein and disposed on opposite sides of said runner, and an ingot mould on the support surface of said sprue plate having a bottom inlet for the acceptance of molten steel, said guide pads extending above the support surface on said sprue plate so as to engage said mould upon horizontal movement thereof relative to said sprue plate, abutment of said ingot mould against each of said guide pads positively positioning the bottom inlet therein over the outlet aperture in said sprue plate.

2. A bottom pour ingot mould system in accordance with claim 1 wherein said runner has an outlet with an upstanding nozzle and the bottom inlet in said mould is telescoped thereover.

3. A bottom pour ingot mould system in accordance with claim 2 wherein said guide pads have a vertical dimension greater than said nozzle to facilitate horizontal movement of said mould into engagement with said guide pads and subsequent downward movement of said mould over said nozzle while engaged with said pads.

* * * * *